US009617797B2

(12) United States Patent
Chau et al.

(10) Patent No.: US 9,617,797 B2
(45) Date of Patent: Apr. 11, 2017

(54) DRILL STRING ADAPTER AND METHOD FOR INGROUND SIGNAL COUPLING

(71) Applicant: Merlin Technology Inc., Kent, WA (US)

(72) Inventors: Albert W. Chau, Woodinville, WA (US); Benjamin John Medeiros, Orting, WA (US)

(73) Assignee: Merlin Technology Inc., Kent, WA (US)

( * ) Notice: Subject to any disclaimer, the term of this patent is extended or adjusted under 35 U.S.C. 154(b) by 335 days.

(21) Appl. No.: 14/193,280

(22) Filed: Feb. 28, 2014

(65) Prior Publication Data

US 2014/0174825 A1 Jun. 26, 2014

Related U.S. Application Data

(63) Continuation of application No. 13/035,774, filed on Feb. 25, 2011, now Pat. No. 8,695,727.

(51) Int. Cl.
*E21B 7/04* (2006.01)
*E21B 17/00* (2006.01)
(Continued)

(52) U.S. Cl.
CPC ..... *E21B 17/003* (2013.01); *E21B 7/046* (2013.01); *E21B 7/30* (2013.01); *E21B 47/02224* (2013.01)

(58) Field of Classification Search
CPC ..... E21B 17/003; E21B 17/02; E21B 17/028; E21B 19/165; E21B 47/02224; E21B 7/30; E21B 7/046
See application file for complete search history.

(56) References Cited

U.S. PATENT DOCUMENTS 4,348,672 A 9/1982 Givler
4,496,203 A 1/1985 Meadows
(Continued)

FOREIGN PATENT DOCUMENTS

GB 2076039 A 11/1981
GB 2427218 A 12/2006
(Continued)

OTHER PUBLICATIONS

Office Action for Chinese Application No. 201280015241.2, which is associated with International Application No. PCT/US2012/024261 which is associated with U.S. Appl. No. 13/035,833, Aug. 25, 2015. (Copy of machine translation also included).
(Continued)

*Primary Examiner* — Brad Harcourt
(74) *Attorney, Agent, or Firm* — Pritzkau Patent Group, LLC

(57) ABSTRACT

A coupling adapter is insertable in at least one joint of a drill string as the drill string is extended from a drill rig. The coupling adapter includes an arrangement for receiving a data signal that is generated by an inground tool and for electromagnetically coupling the data signal onto at least a portion of the drill string that extends from the adapter to the drill rig such that at least some of the drill pipe sections cooperate as an electrical conductor for carrying the data signal to the drill rig. In another feature, a current transformer is resiliently supported to isolate the current transformer from mechanical shock and vibration that is produced by an inground operation that is performed using the drill string. In another feature, a drill string repeater is described.

8 Claims, 10 Drawing Sheets

(51) Int. Cl.
*E21B 47/022* (2012.01)
*E21B 7/30* (2006.01)

(56) References Cited

U.S. PATENT DOCUMENTS

| | | | | |
|---|---|---|---|---|
| 4,578,675 | A | 3/1986 | MacLeod | |
| 4,605,268 | A | 8/1986 | Meador | |
| 4,864,293 | A | 9/1989 | Chau | |
| 4,928,760 | A | 5/1990 | Freitas | |
| 5,138,313 | A | 8/1992 | Barrington | |
| 5,159,978 | A | 11/1992 | Tomek et al. | |
| 5,251,708 | A | 10/1993 | Perry et al. | |
| 5,816,344 | A | 10/1998 | Turner | |
| 5,961,252 | A | 10/1999 | Mercer et al. | |
| 6,035,951 | A | 3/2000 | Mercer et al. | |
| 6,100,696 | A | 8/2000 | Sinclair | |
| 6,134,892 | A | 10/2000 | Turner et al. | |
| 6,367,564 | B1 | 4/2002 | Mills et al. | |
| 6,389,360 | B1 | 5/2002 | Alft et al. | |
| 6,404,350 | B1 | 6/2002 | Soulier | |
| 6,445,307 | B1 | 9/2002 | Rassi et al. | |
| 6,484,818 | B2 | 11/2002 | Alft et al. | |
| 6,496,008 | B1 | 12/2002 | Brune et al. | |
| 6,581,680 | B1 | 6/2003 | Wentworth | |
| 6,866,306 | B2 | 3/2005 | Boyle et al. | |
| 6,899,178 | B2 | 5/2005 | Tubel | |
| 7,012,432 | B2 | 3/2006 | Allan | |
| 7,064,676 | B2 | 6/2006 | Hall et al. | |
| 7,150,329 | B2 | 12/2006 | Chau | |
| 7,170,423 | B2 | 1/2007 | Wisler et al. | |
| 7,362,235 | B1 * | 4/2008 | Normann | E21B 17/028 166/65.1 |
| 7,490,428 | B2 | 2/2009 | Morys | |
| 7,525,315 | B2 | 4/2009 | Fredette et al. | |
| 7,649,474 | B1 | 1/2010 | Gard | |
| 7,775,301 | B2 | 8/2010 | Brune et al. | |
| 7,777,644 | B2 | 8/2010 | Madhavan et al. | |
| 8,695,727 | B2 | 4/2014 | Chau et al. | |
| 9,000,940 | B2 | 4/2015 | Chau | |
| 2003/0192692 | A1 | 10/2003 | Tubel | |
| 2004/0075577 | A1 | 4/2004 | Allan | |
| 2005/0087368 | A1 * | 4/2005 | Boyle | E21B 17/023 175/57 |
| 2007/0023185 | A1 | 2/2007 | Hall et al. | |
| 2007/0029112 | A1 | 2/2007 | Li et al. | |
| 2010/0224356 | A1 | 9/2010 | Moore | |
| 2011/0311305 | A1 | 12/2011 | Cairo et al. | |
| 2012/0085583 | A1 | 4/2012 | Logan | |
| 2012/0217023 | A1 | 8/2012 | Chau et al. | |
| 2012/0218863 | A1 | 8/2012 | Chau et al. | |
| 2013/0043874 | A1 | 2/2013 | Clark et al. | |
| 2013/0176139 | A1 | 7/2013 | Chau et al. | |
| 2014/0055278 | A1 | 2/2014 | Chau et al. | |
| 2014/0262513 | A1 | 9/2014 | Chau et al. | |

FOREIGN PATENT DOCUMENTS

| | | |
|---|---|---|
| RU | 2232888 | 7/2004 |
| RU | 47970 U1 | 9/2005 |
| RU | 65133 U1 | 7/2007 |
| WO | 82/02754 | 8/1982 |
| WO | 99/08035 | 2/1999 |
| WO | 2011/049573 A1 | 4/2011 |
| WO | 2014/031663 A1 | 2/2014 |

OTHER PUBLICATIONS

Office Action for Chinese Application No. 201280015145.8, which is associated with International Application No. PCT/US2012/024257 which is associated with U.S. Appl. No. 13/035,774, Aug. 4, 2015. (Copy of machine translation also included).

The International Search Report and the Written Opinion of the International Searching Authority for International Application No. PCT/US12/24257 which is associated with U.S. Appl. No. 13/035,774, May 17, 2012, Alexandria, Virginia.

The International Search Report and the Written Opinion of the International Searching Authority for International Application No. PCT/US2012/024261 which is associated with U.S. Appl. No. 13/035,833, Jun. 12, 2012, Alexandria, Virginia.

The International Search Report and the Written Opinion of the International Searching Authority for International Application No. PCT/US2013/055828 which is associated with U.S. Appl. No. 13/593,439, Dec. 5, 2013, Moscow, Russia.

The International Search Report and the Written Opinion of the International Searching Authority for International Application No. PCT/2014/022861 which is associated with U.S. Appl. No. 13/827,945, Jul. 10, 2014, Moscow, Russia.

International Preliminary Report on Patentability for International Application No. PCT/2014/022861 which is associated with U.S. Appl. No. 13/827,945, Feb. 24, 2015, Alexandria, Virginia.

Applicant's Instructions to Foreign Associate for Response to 1st Office Action for Chinese Application No. 201280015145.8, which is associated with International Application No. PCT/US2012/024257 which is associated with U.S. Appl. No. 13/035,774, Feb. 17, 2016.

Second Office Action for Chinese Application No. 201280015145.8, which is associated with International Application No. PCT/US2012/024257 which is associated with U.S. Appl. No. 13/035,774, Jun. 3, 2016.

Applicant's Instructions to Foreign Associate for Response to 1st Office Action for Chinese Application No. 201280015241.2, which is associated with International Application No. PCT/US2012/024261 which is associated with U.S. Appl. No. 13/035,833, Feb. 14, 2016.

Second Office Action for Chinese Application No. 201280015241.2, which is associated with International Application No. PCT/US2012/024261 which is associated with U.S. Appl. No. 13/035,833, Jun. 3, 2016. (Copy of machine translation also included).

Extended European Search Report for European Application No. 13830793.9 which is associated with International Application No. PCT/US2013/055828 which is associated with U.S. Appl. No. 13/593,439, Jul. 7, 2016, Munich, Germany.

Extended European Search Report for European Application No. 14773317.4 which is associated with International Application No. PCT/US2014/022861 which is associated with U.S. Appl. No. 13/827,945, Oct. 7, 2016, Munich, Germany.

* cited by examiner

DRILL STRING ADAPTER AND METHOD FOR INGROUND SIGNAL COUPLING

RELATED APPLICATION

This application is a continuation application of copending U.S. patent application Ser. No. 13/035,774 filed on Feb. 25, 2011, the disclosure of which is incorporated herein by reference. The present application is also related to U.S. patent application Ser. No. 13/035,833 filed on Feb. 25, 2011, which shared the filing date of U.S. patent application Ser. No. 13/035,774 filed on Feb. 25, 2011 and which is hereby incorporated by reference in its entirety.

BACKGROUND

The present application is generally related to inground operations and, more particularly, to a system, apparatus and method for electromagnetically coupling an electrical signal onto an electrically conductive drill string to produce a corresponding electrical signal on the drill string.

Generally, an inground operation such as, for example, drilling to form a borehole, subsequent reaming of a borehole for purposes of installing a utility line, borehole mapping and the like use an electrically conductive drill string which extends from an above ground drill rig. The prior art includes examples of the use of an electrically conductive drill string as an electrical conductor for serving to electrically conduct a data signal from an inground tool to the drill rig. The surrounding earth itself serves as a signal return path for purposes of detecting the signal at the drill rig. This type of system is often referred to as a measurement while drilling, MWD, system. Applicants recognize, however, that that there remains a need for improvement in MWD systems.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

Generally, an apparatus and associated method are utilized in a system in which an inground tool is moved through the ground in a region. The system includes a drill rig and a drill string which extends between the inground tool and the drill rig and is configured for extension and retraction from the drill rig. The drill string is made up of a plurality of electrically conductive drill pipe sections, each of which includes a section length and each of which is configured for removable attachment to the inground tool at one joint and to one another at other joints that are formed between adjacent ones of the drill pipe sections such that the drill string includes a plurality of joints to facilitate the extension and retraction of the drill string by one section length at a time. In one aspect of the disclosure, a coupling adapter includes an adapter body that is removably insertable at one of the joints as the drill string is extended to thereafter form part of the drill string. The coupling adapter includes an arrangement for receiving a data signal that is generated by the inground tool and for electromagnetically coupling the data signal, as an electrical signal, onto the adapter body and a portion of the drill string that extends from the adapter to the drill rig such that at least some of the drill pipe sections forming the portion of the drill string cooperate as an electrical conductor for carrying the data signal to the drill rig.

In another aspect of the disclosure, an inground current transformer is arranged for receiving a data signal that is generated by the inground tool on a pair of electrical conductors and for electromagnetically coupling the data signal, as an electrical signal, onto at least a portion of the drill string that extends to the drill rig from the inground tool such that at least some of the drill pipe sections forming the portion of the drill string cooperate as an electrical conductor for carrying the data signal to the drill rig with the current transformer and the pair of electrical conductors maintained in electrical isolation from the drill string.

In still another aspect of the disclosure, a method and associated apparatus are described for use in conjunction with a system in which an inground tool is moved through the ground in a region during an inground operation. The system includes a drill rig and a drill string which extends between the inground tool and the drill rig and is configured for extension and retraction from the drill rig. The drill string is made up of a plurality of electrically conductive drill pipe sections, each of which includes a section length and each of which is configured for removable attachment to the inground tool at one joint and to one another at other joints that are formed between adjacent ones of the drill pipe sections such that the drill string includes a plurality of joints to facilitate the extension and retraction of the drill string by one section length at a time. An apparatus and associated method involve an electronics package that is configured for inground operation. A current transformer is configured for inductively coupled communication with the drill string and for providing communication between the electronics package and the drill rig on the drill string by using the drill string as an electrical conductor. A housing having a housing body is removably insertable at one of the joints as the drill string is extended to thereafter form part of the drill string and the housing is configured at least for receiving the current transformer with the current transformer inductively coupled to the drill string. A support arrangement is configured for resiliently supporting the current transformer on the housing body such that the current transformer is isolated at least to some extent from a mechanical shock and vibration environment to which the housing is subjected responsive to the inground operation.

In yet another aspect of the present disclosure, a repeater and an associated method are described for use in a system in which an inground tool is moved through the ground in a region for performing an inground operation. The system includes a drill rig and a drill string which extends between the inground tool and the drill rig and is configured for extension and retraction from the drill rig. The drill string is made up of a plurality of electrically conductive drill pipe sections, each of which includes a section length and each of which is configured for removable attachment to the inground tool at one joint and to one another at other joints that are formed between adjacent ones of the drill pipe sections such that the drill string includes a plurality of joints to facilitate the extension and retraction of the drill string by one section length at a time. The repeater is configured to include a coupling adapter having an adapter body that is removably insertable at any selected one of the joints as the drill string is extended to thereafter form part of the drill string and the coupling adapter includes a signal coupling arrangement for providing bidirectional electromagnetic coupling between the coupling adapter and the drill string for receiving a data signal that is carried by electrical conduction by at least some of the electrically conductive drill pipe sections making up one portion of the drill string by electromagnetically coupling the data signal from the drill string to the coupling adapter as a received data signal. An inground housing is removably insertable at one of the joints as the drill string is extended to form part of the drill string with the coupling adapter and the inground housing defining a housing cavity. A repeater electronics package is receivable in the housing cavity of the inground housing and can be in electrical communication with the signal coupling arrangement of the coupling adapter for producing a repeater signal based on the received data signal, but which is distinguishable from the received data signal. The repeater signal is provided to the signal coupling arrangement such that the signal coupling arrangement electromagnetically couples the repeater signal back to the drill string for transfer of the repeater signal as another electrical signal along the drill string such that the repeater signal is electrically conducted by at least some of the electrically conductive drill pipe sections making up a different portion of the drill string.

In addition to the exemplary aspects and embodiments described above, further aspects and embodiments will become apparent by reference to the drawings and by study of the following descriptions.

BRIEF DESCRIPTIONS OF THE DRAWINGS

Exemplary embodiments are illustrated in referenced figures of the drawings. It is intended that the embodiments and figures disclosed herein are to be illustrative rather than limiting.

Figure 7A:
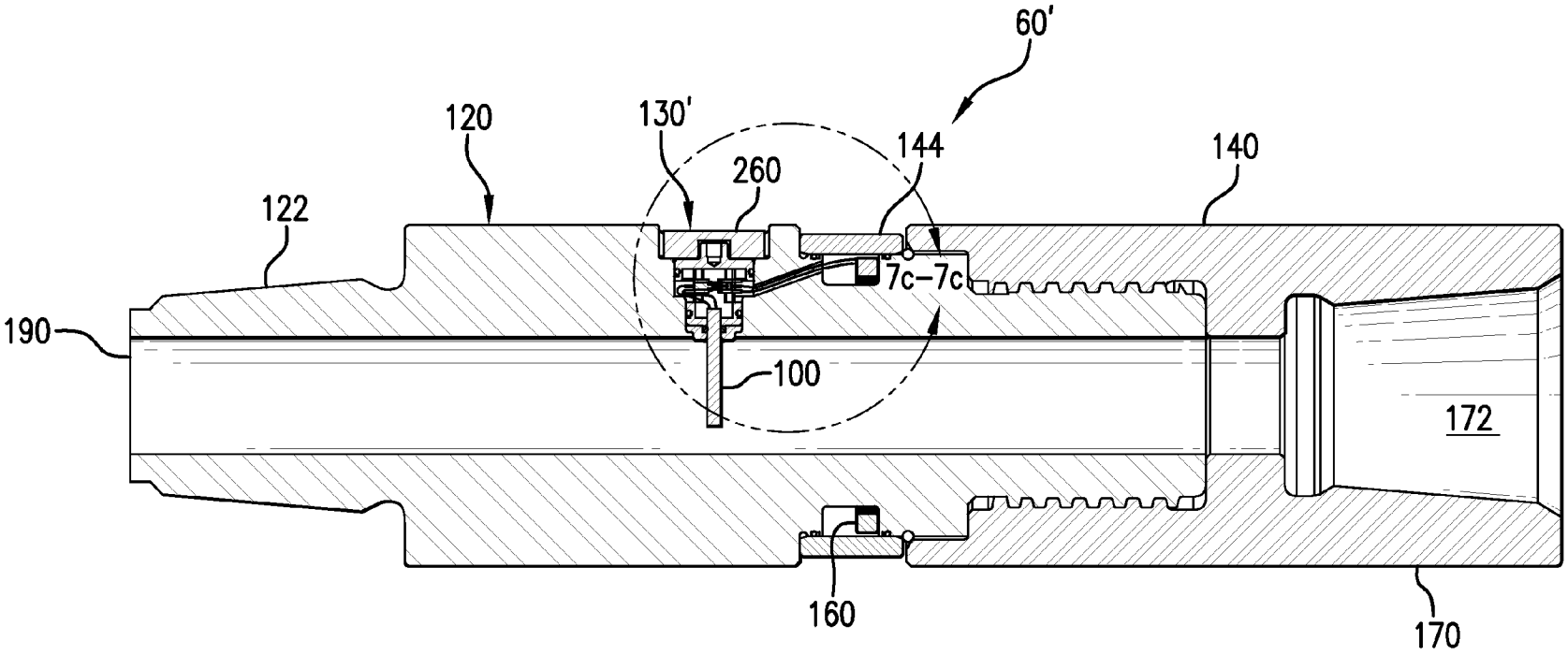

FIG. 7*a* is an elevational view, in diagrammatic partial cross-section, showing another embodiment of the coupling adapter of the present disclosure which electrically isolates both leads of the current transformer from the drill string.

Figure 7B:
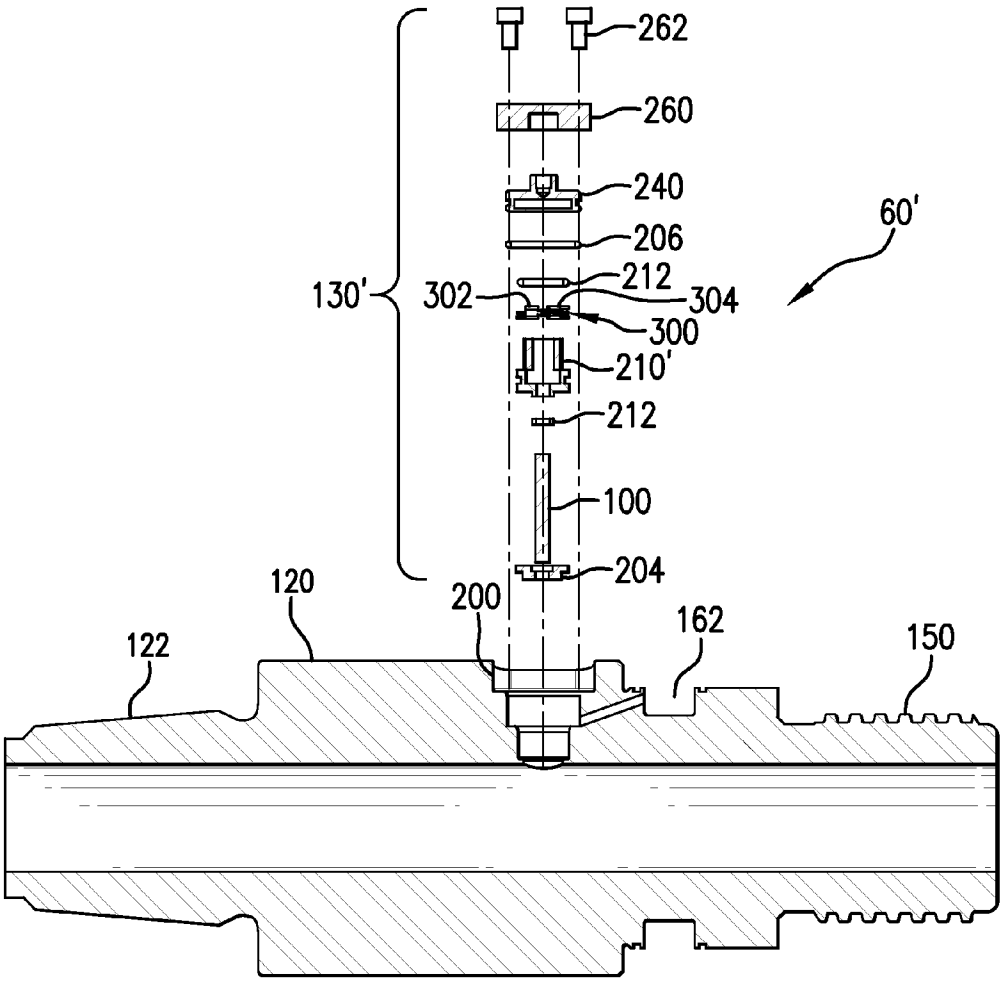

FIG. 7*b* is a diagrammatic exploded view, in elevation and partial cross-section, of the embodiment of the coupling adapter of FIG. 7*a*, shown here to still further illustrate details of its structure.

Figure 7C:
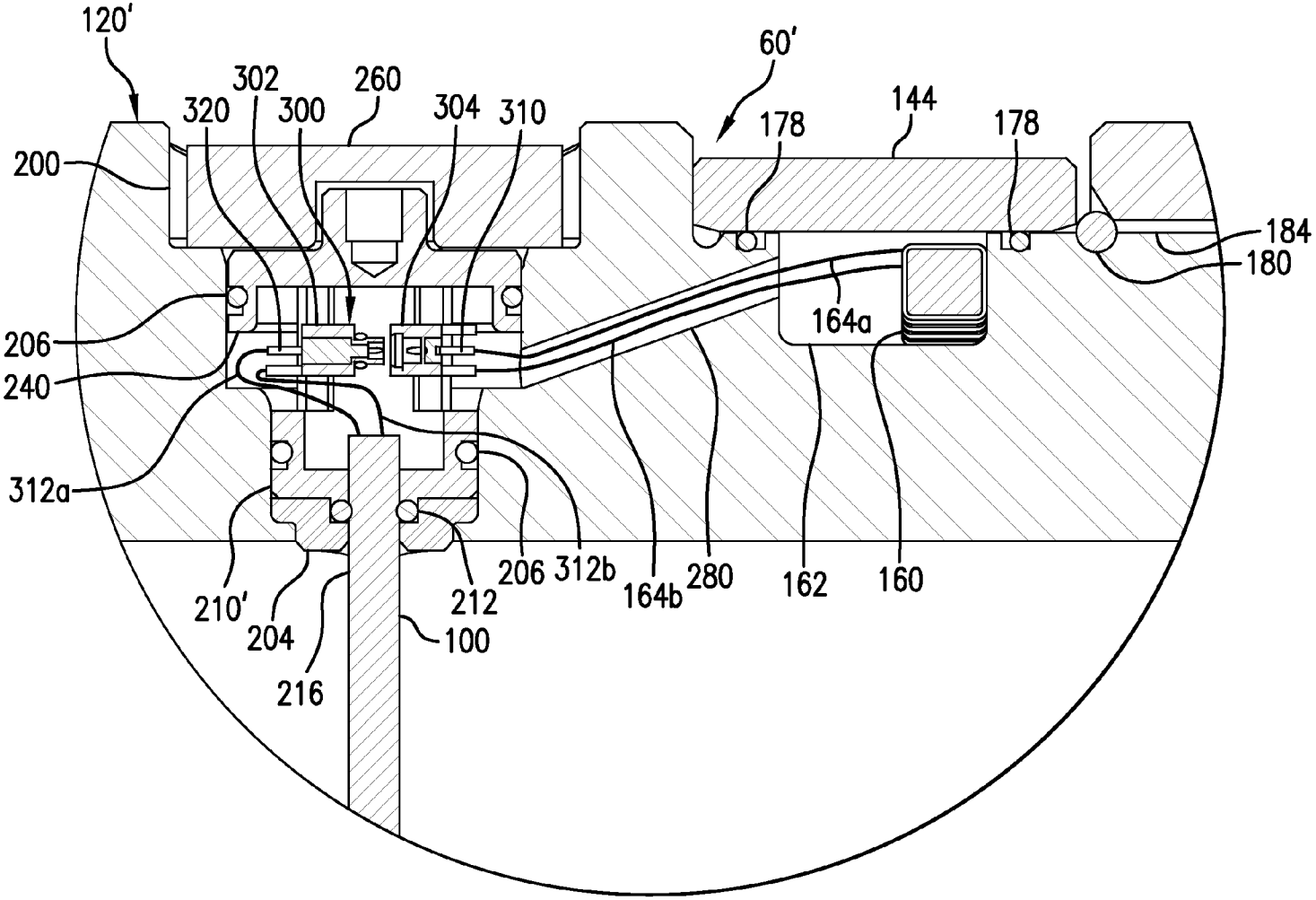

FIG. 7*c* is a further enlarged diagrammatic fragmentary view, in elevation and partial cross-section, taken within a circle 7*c*-7*c* in FIG. 7*a*, shown here to illustrate details with respect to electrical connections in the embodiment of FIGS. 7*a* and 7*b*.

Figure 6:
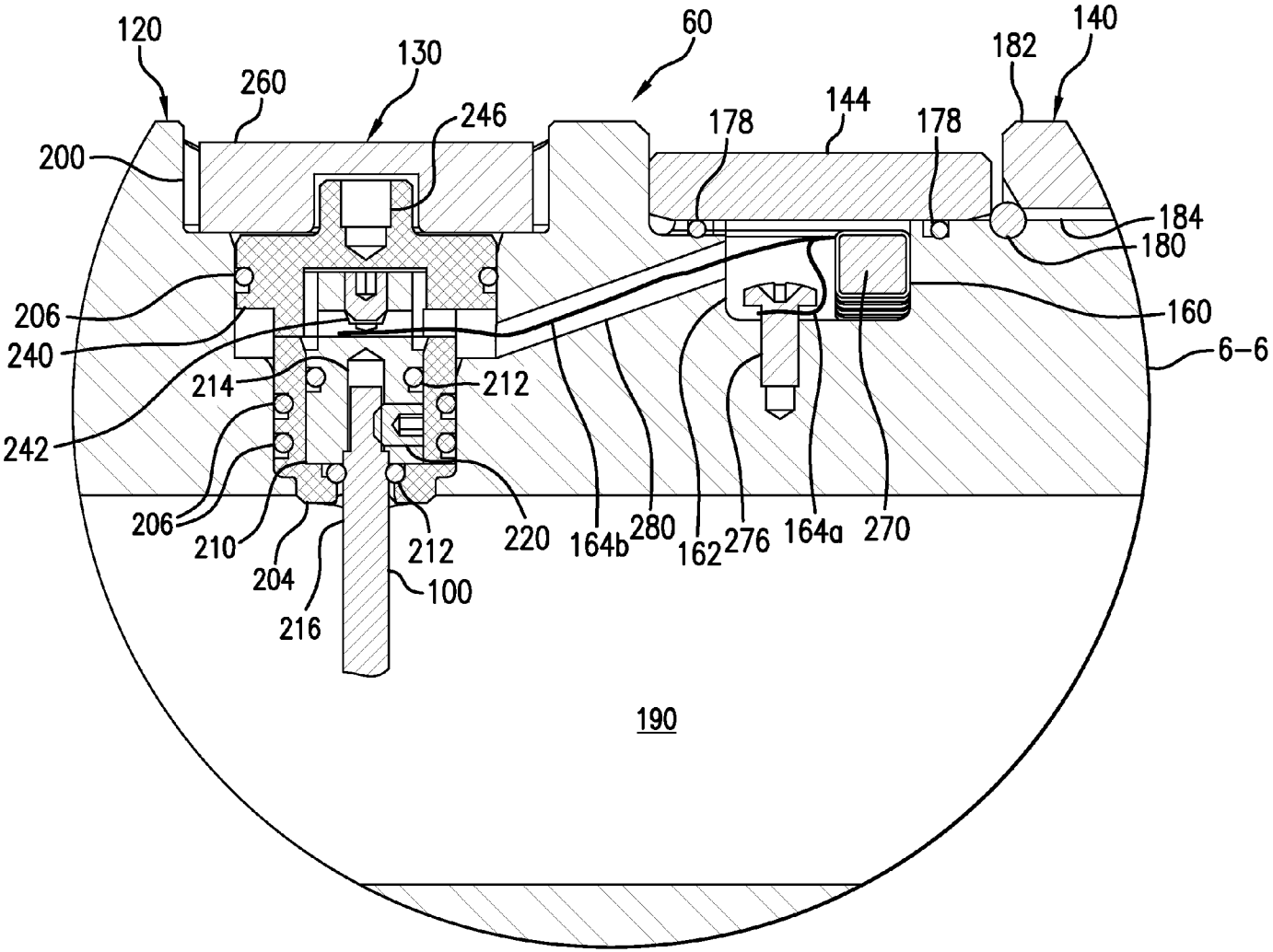
FIG. 6 is a further enlarged fragmentary view, in elevation and partial cross-section, taken within a circle 6-6 in FIG. 5, shown here to illustrate details with respect to electrical connections in the embodiment of FIG. 5 of the coupling adapter.
Figure 7E:
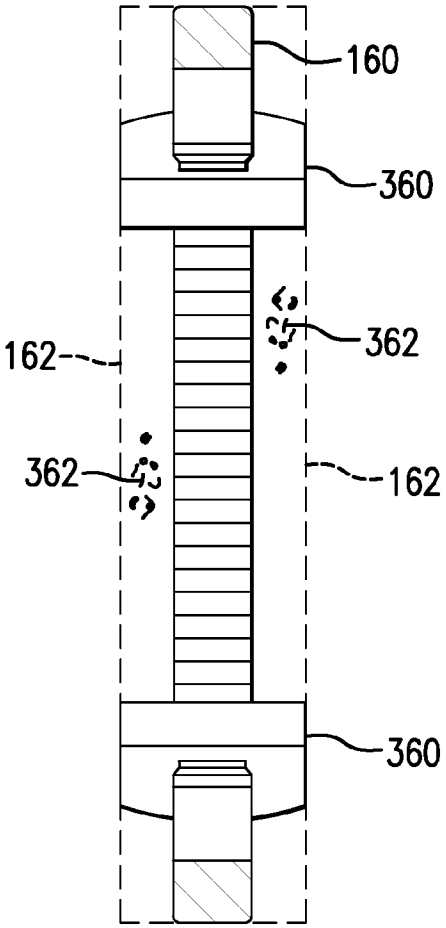
Figure 7D:
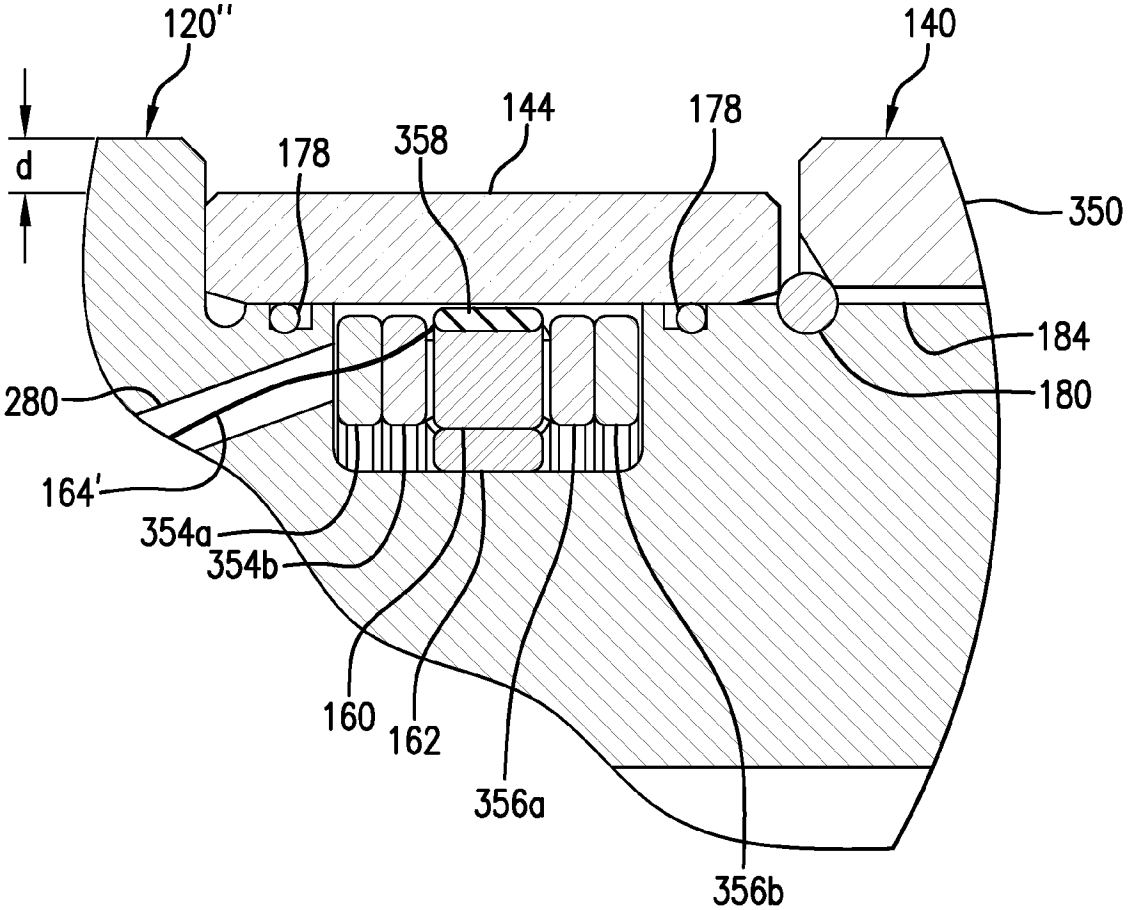

FIG. 7*d* is a further enlarged diagrammatic fragmentary cross-sectional view of another embodiment of the coupling adapter comparable to the views of FIGS. 6 and 7*c*, but which is limited to illustrating the region around the current transformer and ceramic ring, shown here for purposes of illustrating mechanical shock and vibration mitigation features.

FIG. 7*e* is a diagrammatic view, in elevation, of one-half of an overall current transformer that can be used in an embodiment to provide for mechanical shock and vibration isolation of the current transformer from an inground operation using support spacers or donut members.

Figure 8:
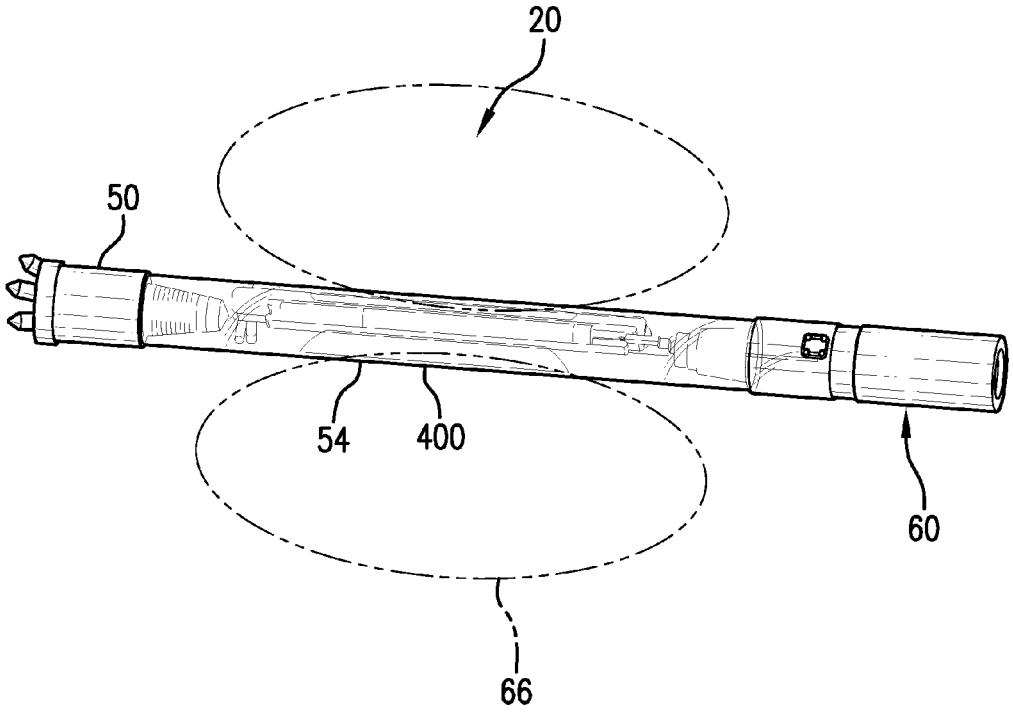

FIG. 8 is a diagrammatic view, in perspective, of one embodiment of an inground tool in the form of a drill head and inground housing connected to the coupling adapter of the present disclosure.

Figure 9:
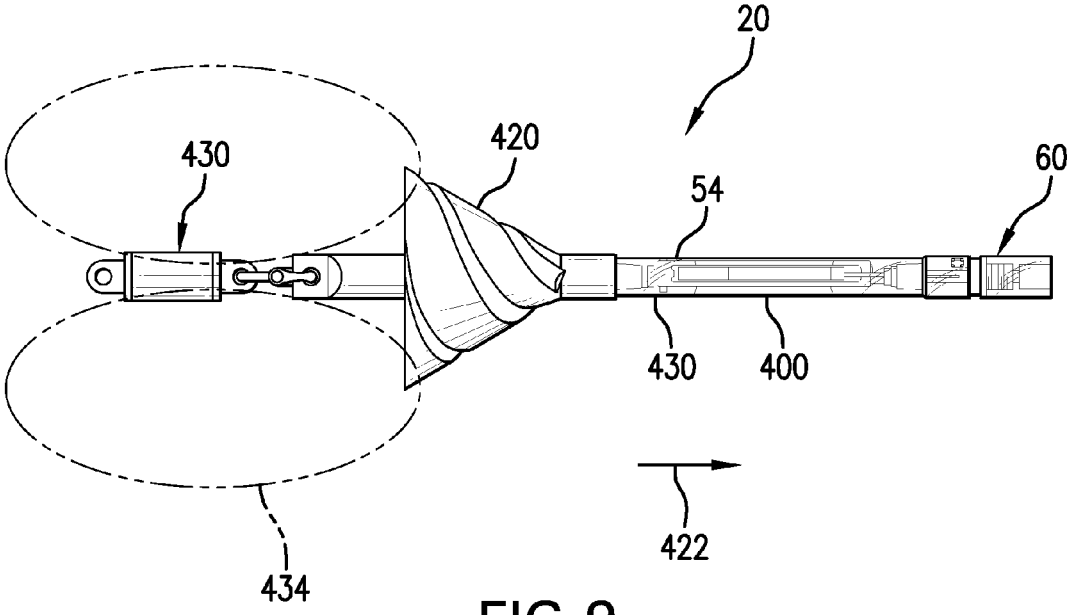

FIG. 9 is a diagrammatic view, in perspective of another embodiment of an inground tool in the form of a tension monitor and reaming tool connected to the coupling adapter of the present disclosure.

Figure 10:
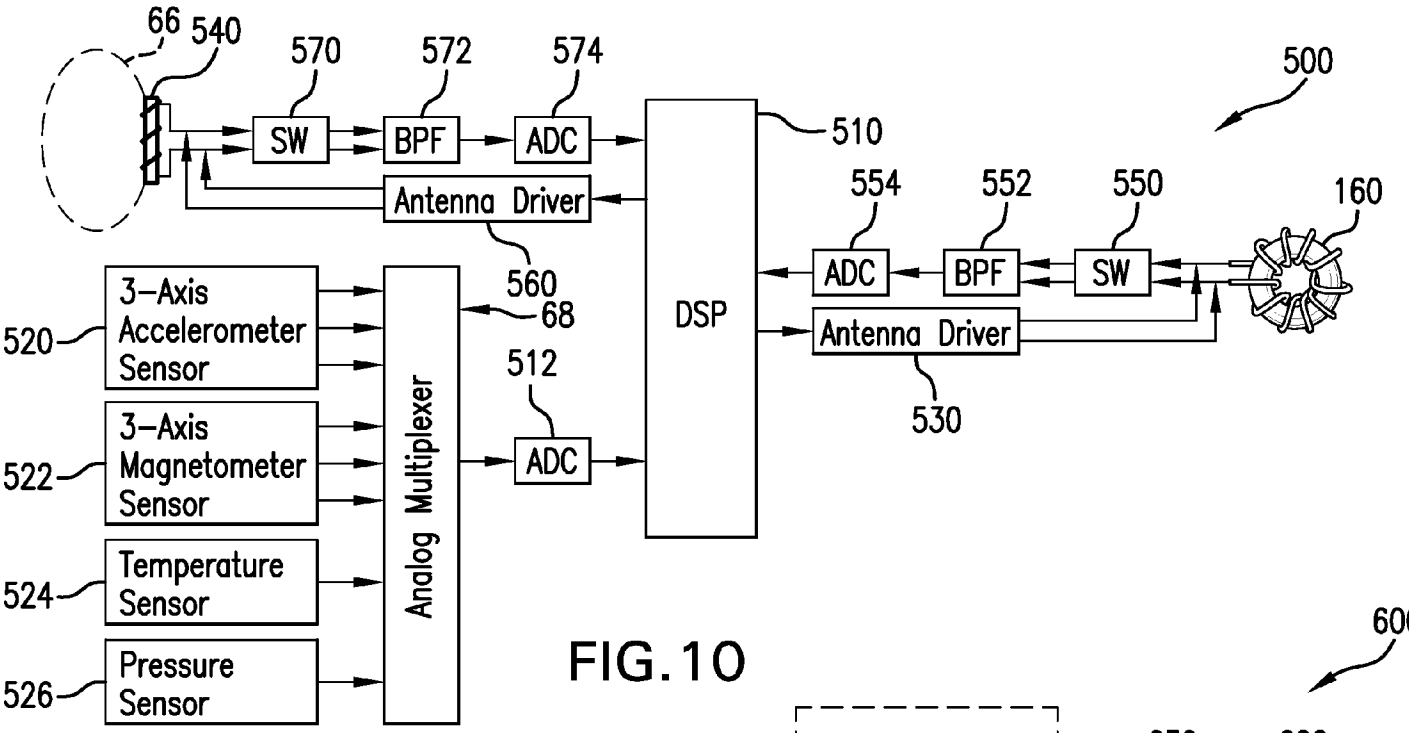

FIG. 10 is a block diagram which illustrates one embodiment of an electronics section that can be used with the coupling adapter of the present disclosure.

Figure 11:
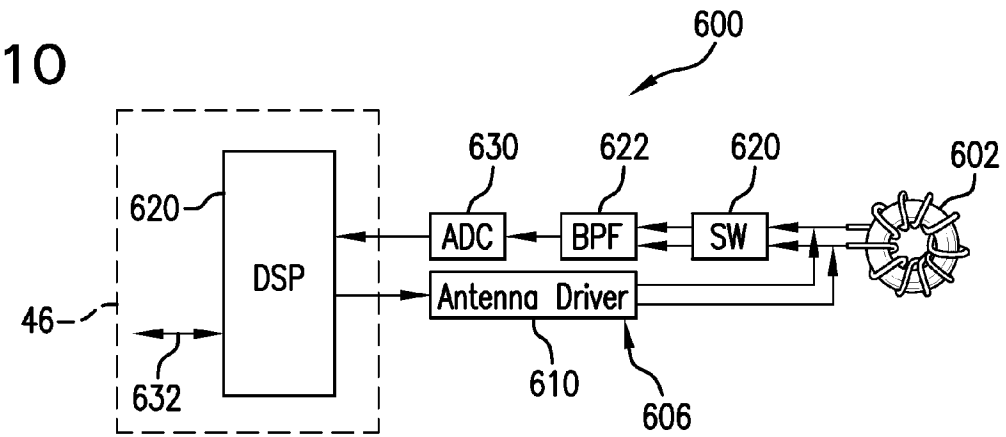

FIG. 11 is a block diagram which illustrates one embodiment of an electronics section that can be used at the drill rig or as part of a drill string repeater in cooperation with the coupling adapter of the present disclosure serving an inground tool.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiment shown, but is to be accorded the widest scope consistent with the principles and features described herein including modifications and equivalents, as defined within the scope of the appended claims. It is noted that the drawings are not to scale and are diagrammatic in nature in a way that is thought to best illustrate features of interest. Descriptive terminology such as, for example, up, down, upper, lower, left, right and the like may be used with respect to these descriptions, however, this terminology has be adopted with the intent of facilitating the reader's understanding and is not intended as being limiting. Further, the figures are not to scale for purposes of illustrative clarity.

Figure 1:
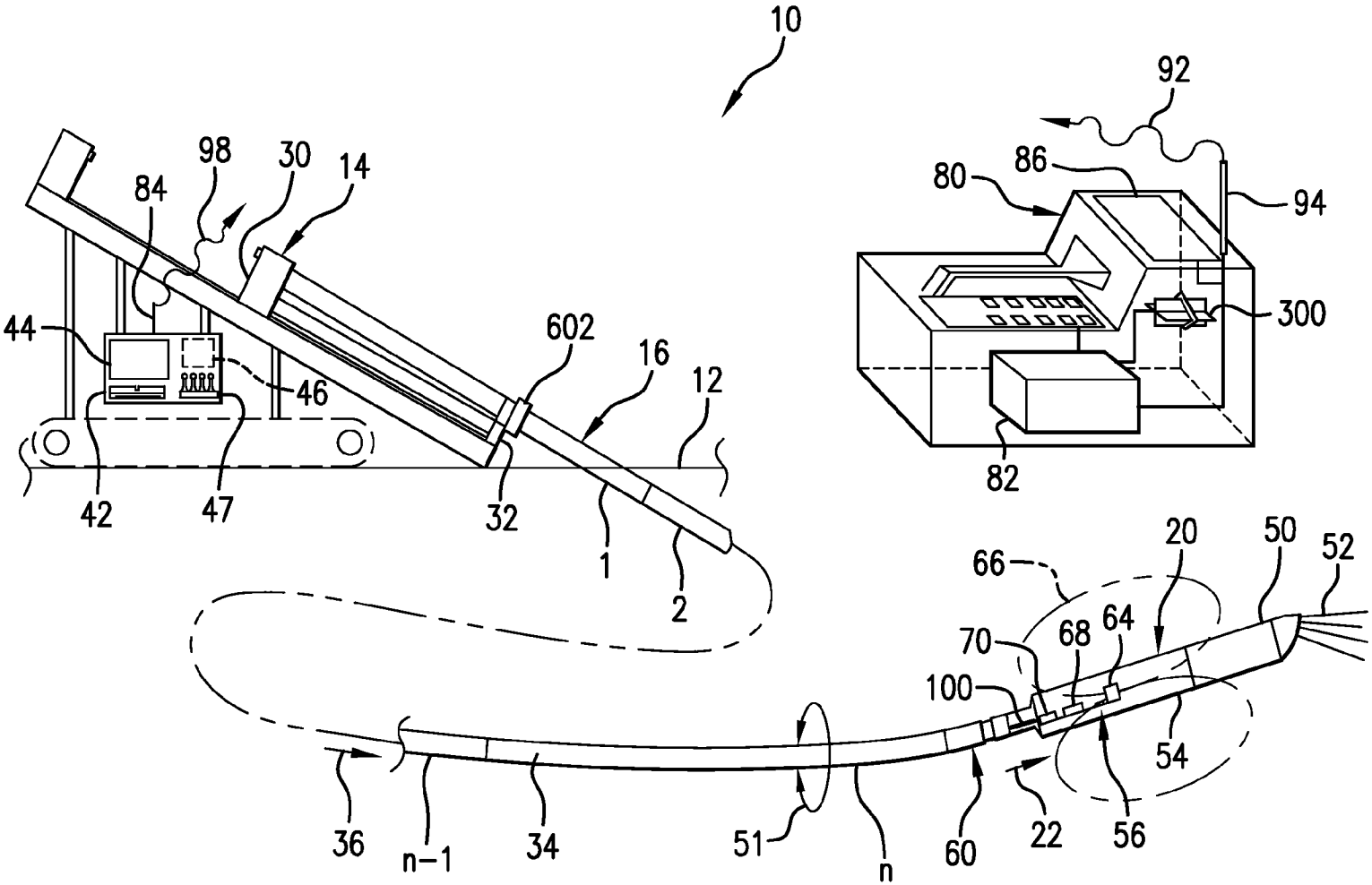
FIG. 1 is a diagrammatic view, in elevation, of a system which utilizes the coupling adapter and inground signal coupling of the present disclosure.

Turning now to the figures wherein like components are indicated by like reference numbers throughout the various figures, attention is immediately directed to FIG. 1 which is an elevational view that diagrammatically illustrates one embodiment of a horizontal directional drilling system generally indicated by the reference number 10 and produced in accordance with the present disclosure. While the illustrated system shows the invention within the framework of a horizontal directional drilling system and its components for performing an inground boring operation, the invention enjoys equal applicability with respect to other operational procedures including, but not limited to vertical drilling operations, pullback operations for installing utilities, mapping operations and the like.

FIG. 1 illustrates system 10 operating in a region 12. System 10 includes a drill rig 14 having a drill string 16 extending therefrom to a boring tool 20. The drill string can be pushed into the ground to move inground tool 20 at least generally in a forward direction 22 indicated by an arrow. While the present example is framed in terms of the use of a boring tool, it should be appreciated that the discussions apply to any suitable form of inground tool including but not limited to a reaming tool, a tension monitoring tool for use during a pullback operation in which a utility or casing can be installed, a mapping tool for use in mapping the path of the borehole, for example, using an inertial guidance unit and downhole pressure monitoring. In the operation of a boring tool, it is generally desirable to monitor based on the advance of the drill string whereas in other operations such as a pullback operation, monitoring is generally performed responsive to retraction of the drill string.

With continuing reference to FIG. 1, drill string 16 is partially shown and is segmented, being made up of a plurality of removably attachable, individual drill pipe sections some of which are indicated as 1, 2, n−1 and n, having a section or segment length and a wall thickness. The drill pipe sections may be referred to interchangeably as drill rods having a rod length. During operation of the drill rig, one drill pipe section at a time can be added to the drill string and pushed into the ground by the drill rig using a movable carriage 30 in order to advance the inground tool. Drill rig 14 can include a suitable monitoring arrangement 32 for measuring movement of the drill string into the ground such as is described, for example, in U.S. Pat. No. 6,035,951 (hereinafter the '951 patent), entitled SYSTEMS, ARRANGEMENTS AND ASSOCIATED METHODS FOR TRACKING AND/OR GUIDING AN UNDERGROUND BORING TOOL, which is commonly owned with the present application and hereby incorporated by reference.

Each drill pipe section defines a through opening 34 (one of which is indicated) extending between opposing ends of the pipe section. The drill pipe sections can be fitted with what are commonly referred to as box and pin fittings such that each end of a given drill pipe section can threadingly engage an adjacent end of another drill pipe section in the drill string in a well known manner. Once the drill pipe sections are engaged to make up the drill string, the through openings of adjacent ones of the drill pipe sections align to form an overall pathway 36 that is indicated by an arrow. Pathway 36 can provide for a pressurized flow of drilling fluid or mud, consistent with the direction of arrow 36, from the drill rig to the drill head, as will be further described.

The location of the boring tool within region 12 as well as the underground path followed by the boring tool may be established and displayed at drill rig 14, for example, on a console 42 using a display 44. The console can include a processing arrangement 46 and a control actuator arrangement 47.

Boring tool 20 can include a drill head 50 having an angled face for use in steering based on roll orientation. That is, the drill head when pushed ahead without rotation will generally be deflected on the basis of the roll orientation of its angled face. On the other hand, the drill head can generally be caused to travel in a straight line by rotating the drill string as it is pushed as indicated by a double headed arrow 51. Of course, predictable steering is premised upon suitable soil conditions. It is noted that the aforementioned drilling fluid can be emitted as jets 52 under high pressure for purposes of cutting through the ground immediately in front of the drill head as well as providing for cooling and lubrication of the drill head. Boring tool 20 includes an inground housing 54 that receives an electronics package 56. The inground housing is configured to provide for the flow of drilling fluid to drill head 50 around the electronics package. For example, the electronics package can be cylindrical in configuration and supported in a centered manner within housing 54. Drill head 50 can include a box fitting that receives a pin fitting of inground housing 54. An opposing end of the inground housing can include a box fitting that receives a pin fitting of a coupling adapter 60. An opposing end of coupling adapter 60 can include a box fitting that receives a pin fitting which defines a distal, inground end of the drill string. It is noted that the box and pin fittings of the drill head, the inground housing and the coupling adapter are generally the same box and pin fittings as those found on the drill pipe sections of the drill string for facilitating removable attachment of the drill pipe sections to one another in forming the drill string. Inground electronics package 56 can include a transceiver 64 which, in some embodiments, can transmit a locating signal 66 such as, for example, a dipole locating signal, although this is not required. In some embodiments, transceiver 64 can receive an electromagnetic signal that is generated by other inground components as will be described at an appropriate point below. The present example will assume that the electromagnetic signal is a locating signal in the form of a dipole signal for descriptive purposes. Accordingly, the electromagnetic signal may be referred to as a locating signal. It should be appreciated that the dipole signal can be modulated like any other electromagnetic signal and that the modulation data is thereafter recoverable from the signal. The locating functionality of the signal depends, at least in part, on the characteristic shape of the flux field and its signal strength rather than its ability to carry modulation. Thus, modulation is not required. Information regarding certain parameters of the boring tool such as, for example, pitch and roll (orientation parameters), temperature and drilling fluid pressure can be measured by a suitable sensor arrangement 68 located within the boring tool which may include, for example, a pitch sensor, a roll sensor, a temperature sensor, an AC field sensor for sensing proximity of 50/60 Hz utility lines and any other sensors that are desired such as, for example, a DC magnetic field sensor for sensing yaw orientation (a tri-axial magnetometer, with a three axis accelerometer to form a electronic compass to measure yaw orientation). Electronics package 56 further includes a processor 70 that is interfaced as necessary with sensor arrangement 68 and transceiver 64. Another sensor that can form part of the sensor arrangement is an accelerometer that is configured for detecting accelerations on one or more axes. A battery (not shown) can be provided within the housing for providing electrical power.

A portable locator 80 can be used to detect electromagnetic signal 66. One suitable and highly advanced portable locater is described in U.S. Pat. No. 6,496,008, entitled FLUX PLANE LOCATING IN AN UNDERGROUND DRILLING SYSTEM, which is commonly owned with the present application and is incorporated herein by reference in its entirety. As mentioned above, the present descriptions apply to a variety of inground operations and are not intended as being limiting, although the framework of horizontal directional drilling has been employed for descriptive purposes. As discussed above, the electromagnetic signal can carry information including orientation parameters such as, for example, pitch and roll. Other information can also be carried by the electromagnetic signal. Such information can include, by way of example, parameters that can be measured proximate to or internal to the boring tool including temperatures and voltages such as a battery or power supply voltage. Locator 80 includes an electronics package 82. It is noted that the electronics package is interfaced for electrical communication with the various components of the locator and can perform data processing. Information of interest can be modulated on electromagnetic signal 66 in any suitable manner and transmitted to locator 80 and/or an antenna 84 at the drill rig, although this is not required. Any suitable form of modulation may be used either currently available or yet to be developed. Examples of currently available and suitable types of modulation include amplitude modulation, frequency modulation, phase modulation and variants thereof. Any parameter of interest in relation to drilling such as, for example, pitch may be displayed on display 44 and/or on a display 86 of locator 80 as recovered from the locating signal. Drill rig 14 can transmit a telemetry signal 98 that can be received by locator 80. The telemetry components provide for bidirectional signaling between the drill rig and locator 80. As one example of such signaling, based on status provided by drill rig monitoring unit 32, the drill rig can transmit an indication that the drill string is in a stationary state because a drill pipe section is being added to or removed from the drill string.

Still referring to FIG. 1, an electrical cable 100 can extend from inground electronics package 56 such that any sensed value or parameter relating to the operation of the inground tool can be electrically transmitted on this cable. One of ordinary skill in the art will appreciate that what is commonly referred to as a "wire-in-pipe" can be used to transfer signals to the drill rig. The term wire-in-pipe refers to an electrical cable that is housed within interior passageway 36 that is formed by the drill string. In accordance with the present disclosure, however, cable 100 extends to inground coupling adapter 60, as will be further described immediately hereinafter.

Figure 2:
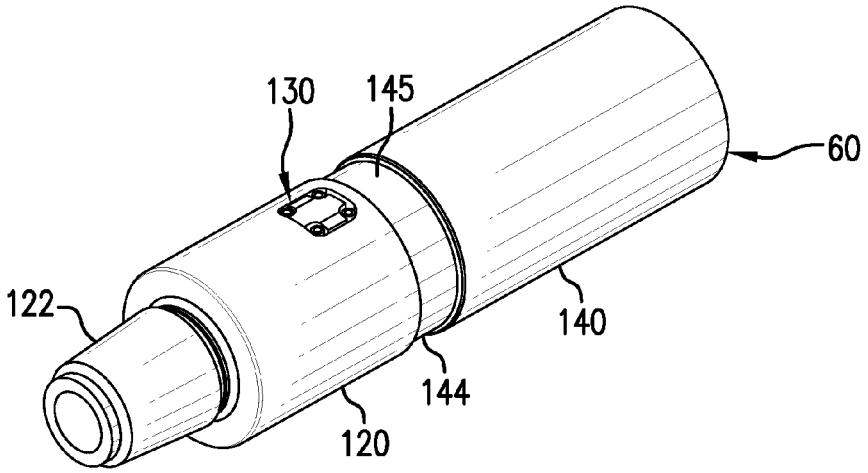
FIG. 2 is a diagrammatic perspective view of one embodiment of the coupling adapter of the present disclosure.

Attention is now directed to FIG. 2 in conjunction with FIG. 1. FIG. 2 is a diagrammatic perspective view which illustrates one embodiment of coupling adapter 60 in further detail. In particular, the coupling adapter includes a main body 120 which forms a pin fitting 122 for engaging a box fitting (not shown) of inground housing 54. It is noted that threads have not been shown on the pin fitting for purposes of illustrative clarity, but are understood to be present. The main body includes at least one high pressure electrical connection assembly 130 which will be described in further detail at one or more appropriate points below. Coupling adapter 60 further includes an extension body 140 that is removably attachable to main body 120 such that either the main body or extension body can be replaced. The main body and extension body can be formed from any suitable material such as, for example, from nonmagnetic alloys including nonmagnetic stainless steels and from magnetic alloys such as, for example, 4140, 4142, 4340 or any suitable high strength steel. Particularly when the coupling adapter is to be placed many feet or many drill rods from the electronics module which drives it, a non-magnetic version may not be needed. However, if the coupling adapter is to be used near an inground device such as, for example, a steering tool which detects the magnetic field of the Earth, the use of a nonmagnetic material avoids potential field disturbance. It is well known, in this regard, that non-magnetic, high strength alloys as opposed to their magnetic counterparts are typically much higher in cost. It is noted that there is no requirement that the main body and extension body are formed from the same material.

A cylindrical ring 144 is received between main body 120 and extension body 140. The cylindrical ring can be formed from any suitable material which is generally resistant to the inground environment and which is electrically insulative. By way of non-limiting example, one suitable material is transformation toughened zirconium oxide ceramic, other ceramic materials may also be suitable. As seen in FIG. 2 and other figures yet to be described, an outer surface 145 of cylindrical ring 144 can be inset with respect to outer surfaces of both the main body and extension body for purposes of reducing the potential of damage to the cylindrical ring as well as reducing wear on the cylindrical ring. For example, a clamp (not shown) at the drill rig that holds pipe sections, based on the inset of the cylindrical ring and in the event that the clamp happens to engage the coupling adapter, bridges across and remains out of contact with the cylindrical ring based on the inset. Further, inground wear of the cylindrical ring can be reduced due to rotation, advancement and retraction of the drill string. In this regard, it should be appreciated that electrical connection assembly 130 can be inset for similar reasons as can be seen in FIG. 2, as well as in figures yet to be described.

Figure 3:
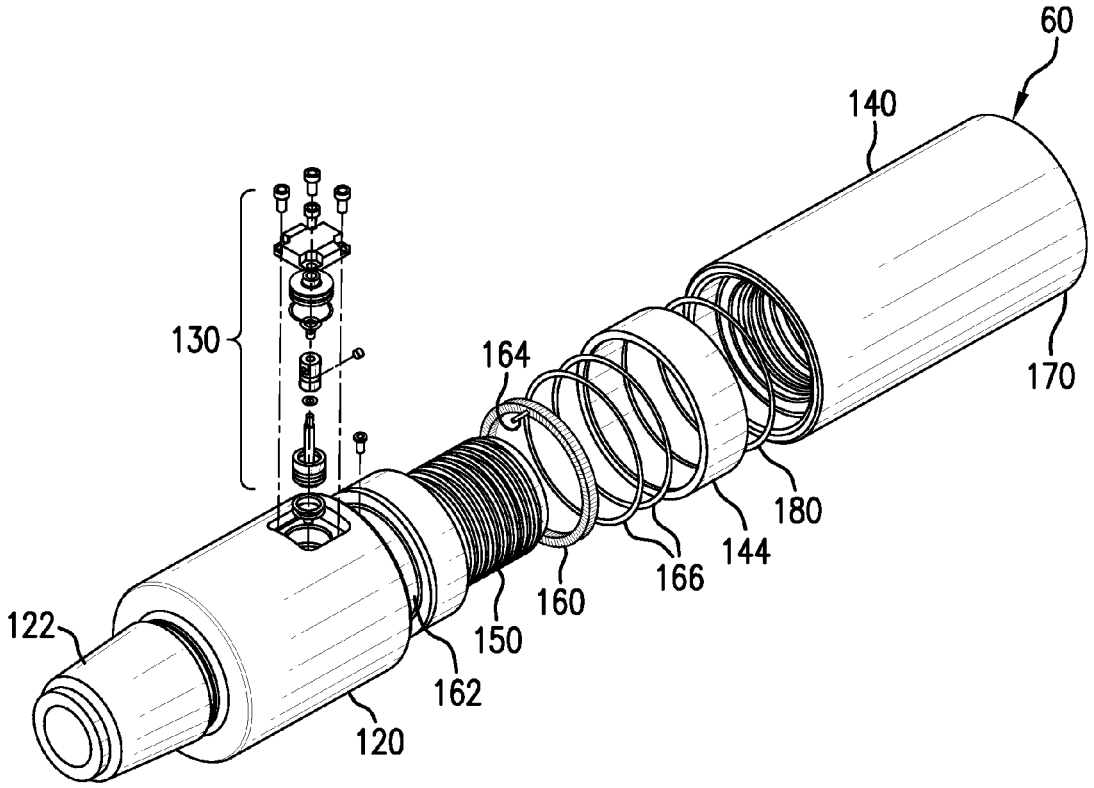
FIG. 3 is a diagrammatic exploded view, in perspective, of the embodiment of the coupling adapter of FIG. 2, shown here to illustrate details of its structure.
Figure 4:
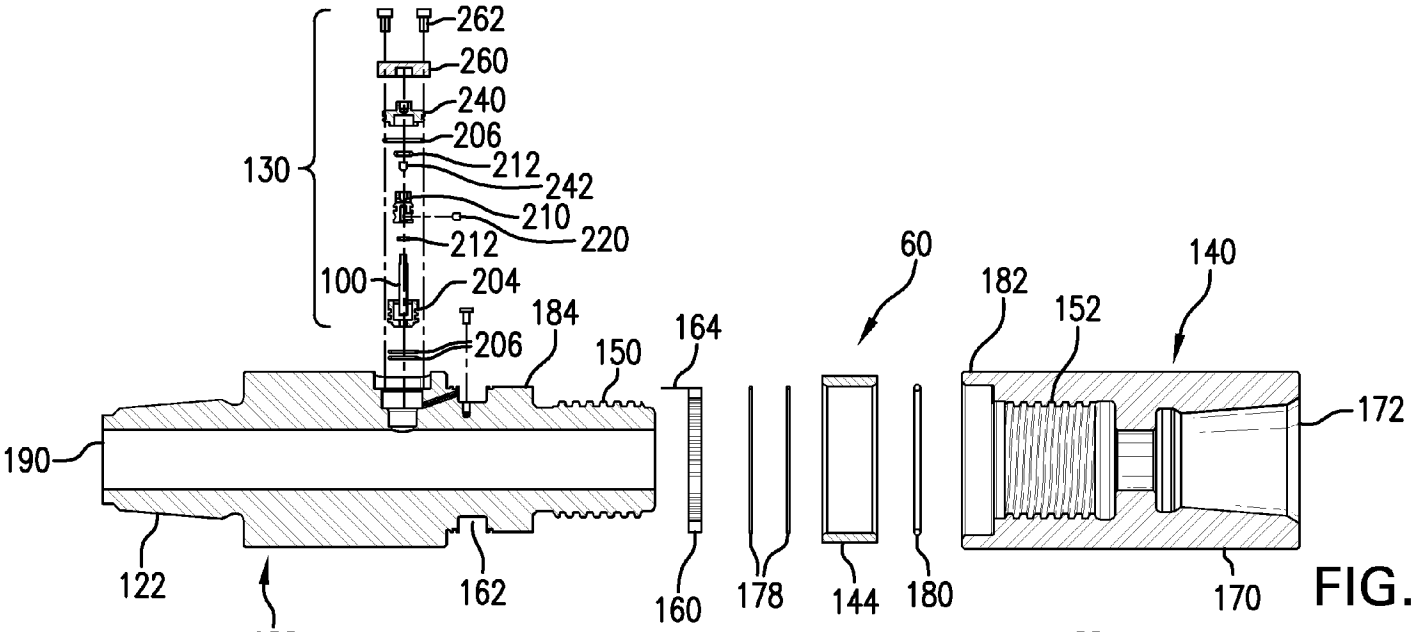
FIG. 4 is a diagrammatic exploded view, in elevation and partial cross-section, of the embodiment of the coupling adapter of FIGS. 2 and 3, shown here to still further illustrate details of its structure.

Referring to FIGS. 2-4, further details of the structure of coupling adapter 60 will now be provided. FIG. 3 is a diagrammatic exploded perspective view of the coupling adapter while FIG. 4 is a diagrammatic exploded elevational view, in partial cross-section, of the coupling adapter. Main body 120 includes an attachment end 150 which is threaded to threadingly engage a threaded receptacle 152 that is defined by extension body 140. It should be appreciated that threaded engagement is not a requirement and that any suitable technique can be employed for attaching the extension body to the main body, including but not limited to the use of fasteners, adhesives and a spline with spiral pins. It should be appreciated that this attachment is subject to the full torque, push force and pull force of any inground operation to which it is subjected. When a threaded embodiment is used, in order to further insure that the connection does not loosen, an epoxy can be applied or a thread locking compound such as, for example, a methacrylate adhesive or a water impervious commercial thread locking compound, before the coupling is torqued. In one embodiment, the pin of the male thread is designed to bottom as soon as the shoulders are in contact, which is well known in the relevant art as double shouldering.

A current transformer 160 is configured for installation in a transformer recess or groove 162 that is defined by main body 120. The current transformer includes a coil that is wound upon an annular or toroidal core. In this regard, the core can include any suitable cross-sectional shape such as, for example, rectangular, square and circular. In the embodiment which is illustrated, the core can be split in order to facilitate installation of the current transformer into transformer groove 162. A pair of electrical leads 164 terminate the opposing ends of the current transformer coil for forming external electrical connections yet to be described. It should be appreciated that any suitable current transformer can be used and that the particular current transformer that is described here is not intended as limiting. An opposing end 170 of extension body 140 defines a box fitting 172 for threadingly engaging the inground, distal end of the drill string. With regard to FIG. 1, it should be appreciated that coupling adapter 60 can be installed between any two adjacent ones of the drill pipe sections as the drill string is assembled at the drill rig. For example, coupling adapter 60 can be located between drill pipe sections n-1 and n in FIG. 1. Cable 100 then extends from the inground tool through drill pipe section n to reach the coupling adapter.

Figure 5:
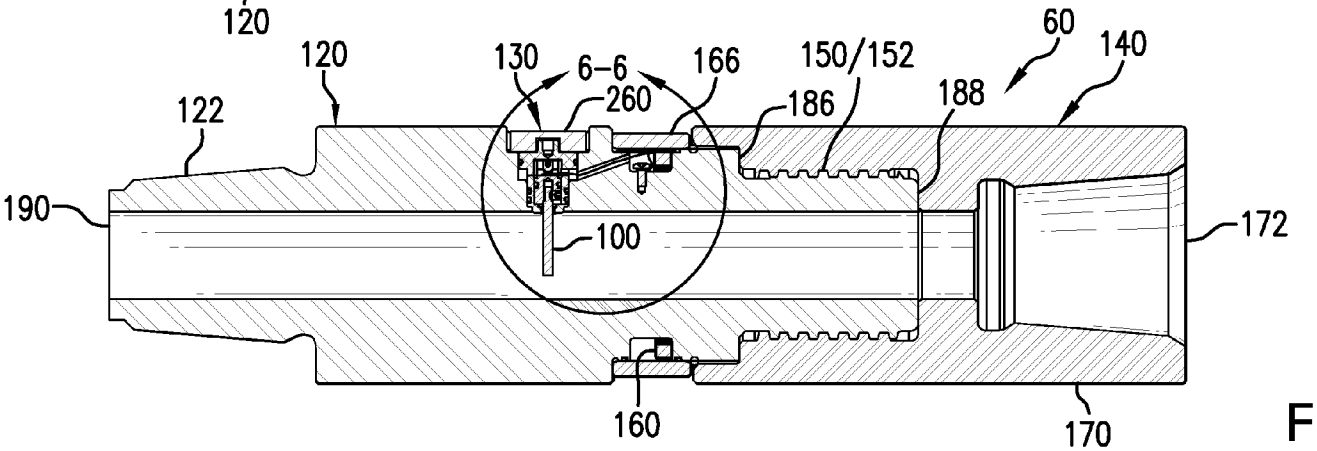
FIG. 5 is a diagrammatic assembled view, in elevation and partial cross-section, of the embodiment of the coupling adapter of FIGS. 2-4, showing details with respect to its assembled configuration.

Referring to FIGS. 5 and 6 in conjunction with FIGS. 2-4, FIG. 5 is an elevational, assembled view, in partial cross-section, of coupling adapter 60 while FIG. 6 is a further enlarged assembled view, in partial cross-section, taken within a circle 6-6 that is shown in FIG. 5. O-rings 178 can be used for purposes of forming a seal between main body 120 and an inner surface of cylindrical ring 144, when assembled as seen in FIG. 6, for purposes yet to be described, whereas an O-ring 180 serves to stabilize the ceramic ring and limit direct contact with a flange 182 of extension body 140. O-ring 180 can contact the ceramic ring, flange 182 and a sidewall 184 of main body 120. As seen in FIG. 5, the components of coupling adapter 60 assemble to cooperatively define a through passage 190 for purposes of conducting drilling fluid as part of or in cooperation with the overall drill string when such fluid is needed by the inground tool. A pressure seal between main body 120 and extension body 140 can be accomplished, when assembled, such that drilling fluid is unable to escape between the main and extension bodies, even when the drilling fluid is under high pressure, based on a double shoulder configuration including first and second shoulders 186 and 188 (FIG. 5). Further, a suitable sealing compound such as, for example, an epoxy compound can be applied to the threads between shoulders 186 and 188 to provide for additional sealing.

With primary reference to FIG. 6 in conjunction with FIG. 4, attention is now directed to details of one embodiment of high pressure electrical connection assembly 130. In this regard, it is noted that the high pressure electrical connection assembly is shown in an exploded view in FIG. 4 and an assembled view in FIG. 6. The high pressure electrical connection assembly is arranged in a stepped aperture 200 that is defined in the sidewall of main body 120 for purposes of electrically connecting to current transformer 160. The connection assembly includes a lower insulator 204 defining grooves in which O-rings 206 are received to seal the lower insulator against the stepped periphery of aperture 200 so as to prevent the escape of pressurized fluid/fluid, for example, when used during a drilling operation. The overall shape of lower insulator 204 is that of a cup with a centered opening in the bottom of the cup. The lower insulator can be formed from any suitable electrically insulating material that is able to tolerate sometimes hostile inground environments. Such suitable materials include but are not limited to high performance polymers that are not electrical conductors. The cavity of the cup defined by the lower insulator receives a power pin 210 which can be sealed against the lower insulator using O-rings 212. The power pin defines a centered aperture 214. The power pin can be formed from any suitable electrically conductive materials that are able to tolerate the sometimes hostile inground environment. Such materials include, but are not limited to electroless nickel plated beryllium copper or phosphor bronze. A distal end 216 of cable 100 is received in the centered opening of lower insulator 204 and within centered aperture 214 of power pin 210. A set screw 220 threadingly engages a sidewall of the power pin and extends into centered cavity 214 to engage and retain distal end 216 of the cable within the power pin in a way that electrically connects the power pin to cable 100. As opposed to the use of set screw 220, any suitable arrangement may be used to retain the distal end of the cable within the power pin and electrically connected thereto.

Still referring to FIGS. 6 and 4, an upper insulator 240 is received in stepped aperture 200 and sealed thereagainst using one of O-rings 206. A set screw 242 can threadingly engage the upper insulator for purposes which will be made evident below. Upper insulator 240 can be formed from any suitable material including those materials from which lower insulator 204 can be formed. Set screw 242 is installed prior to installing upper insulator 240 and can be accessed by removing the upper insulator. An opening 246 can be defined by the upper insulator for purposes of facilitating removal of the upper insulator, for example, by receiving a threaded end of a pulling tool. A cover 260 is received against an upper step of stepped aperture 200 and can be held in place, for example, by threaded fasteners 262 (FIG. 4). The cover can be formed from any suitable material including but not limited to steel. One material that has been found to be suitable is heat treated 17-4 steel. As seen in FIG. 6, an outer surface of cover 260 can be inset with respect to outer surfaces of both the main body and extension body for purposes of reducing wear and for avoiding contact with a clamping mechanism at the drill rig.

As discussed above, current transformer 160 is received in annular groove 162, for example, using a split annular core 270. Leads 164*a* and 164*b* extend from a coil 272 of the current transformer. Lead 164*a* is captured in electrical connection with main body 120 by a set screw 276. Lead 164*b* is extended through an inside passage 280 which is defined by main body 120 and leads from annular groove 162 to stepped aperture 200. The end of lead 164*b* is captured in electrical connection with power pin 210 by set screw 242 such that current transformer lead 164*b* is electrically connected to cable 100. Any suitable arrangement can be used for forming an electrical connection between lead 164*b* and the power pin. The current transformer is designed with at least the following in mind:

a. Shock and vibration. The material selection and construction should withstand the shock and vibration for the downhole drilling environment.
b. Magnetic material selection should be based on low core loss at the operating frequency, high flux saturation and mechanical robustness.
c. High flux saturation permits a reduction in cross-sectional area of the magnetic core, to provide for increasing the cross-sectional area of the adapter coupling main body for torque and power transmission.
d. Low inter winding capacitance for high frequency response.

In view of the foregoing, in one embodiment and by way of non-limiting example, a tape wound core can be used. As will be familiar to one of ordinary skill in the art such cores are less susceptible to shock and vibration than ferrite cores. Such a tape wound core can be produced using a thin, high magnetic flux saturation tape in order to avoid eddy current losses in the core. In some embodiments, the tape thickness can range from 0.00025" to 0.001". One suitable thickness is 0.0007". The tape wound core can be finished, for example, using powder coating or epoxy coating. In one embodiment, additional vibration and shock protection can be provided for the current transformer and its core based on the manner by which the current transformer is mounted in groove 162, as will be described at an appropriate point hereinafter.

The current transformer can use the drill pipe in the manner of a single turn secondary and the surrounding soil to form a complete current path. The primary winding of the current transformer can convert a low current output from the drive electronics to a high current signal on the drill pipe with the drill pipe itself serving as the single turn secondary. Of course, the terms, primary and secondary can be used interchangeably based on the direction of signal coupling and have been applied here for descriptive and non-limiting purposes. The current ratio is proportional to the number of turns on the primary. For example, neglecting magnetic and resistive losses, if the current into the primary is 10 mA rms, the current induced on the drill pipe will be 1000 mA which is one hundred times higher than the input current if the ratio of primary to secondary turns is 100/1. As noted above, the tape wound core can be encapsulated in epoxy for added mechanical strength, using any suitable thermal plastic or epoxy. The finished core or toroid can be cut, for example, with a diamond saw into two half cores for installation purposes with the transformer windings applied to each core half. A small gap, for example, of about 0.001" can be formed between the confronting surfaces of the core half ends by bonding a piece of non-magnetic material, such as mylar, a strong polyester film between the confronting surfaces, to create a magnetic gap. This gap helps to prevent magnetic saturation of the core. As is well known in the art, the cross-section of the core can be determined by the frequency, flux density, number of turns of magnet wire (for example, an insulated copper wire), saturation flux density and applied voltage to the current transformer. With frequency from a few kilohertz to a hundred kilohertz, the cross-section, by way of example, can be approximately 0.2" by 0.2". In some embodiments, the current transformer can be shock mounted in the adapter groove, as will be further described at one or more points hereinafter.

Assembly of the embodiment shown in FIG. 6 can proceed, for example, by first installing current transformer 160 into annular groove 162. Cable 100 can be extended into through passage 190 of the main body and out of stepped aperture 200. Lower insulator 204 can then be installed onto cable 100 with power pin 210 installed onto the distal end of the cable by tightening set screw 220. The power pin can be received in the stepped periphery as seen in FIG. 6. Current transformer lead 164*b* can be threaded through passage 280 having its distal end positioned as shown in FIG. 6. Upper insulator 240 can then be installed and set screw 242 tightened. Cover 260 can then be installed. Installation of current transformer lead 164*a* and cylindrical ring 144 proceed in a straightforward manner. It should be appreciated that the current transformer, cylindrical ring and high pressure electrical connector assembly are readily replaceable/repairable in the field.

Referring to FIG. 7*a*, another embodiment of a coupling adapter in accordance with the present disclosure is generally indicated by the reference number 60' and shown in a partially cross-sectional view. Descriptions of like components, shown in previous figures, have not been repeated for purposes of brevity. In this regard, the difference between the present embodiment and the previously described embodiment resides primarily in the configuration of electrical connection assembly 130' as part of a modified main body 120', as will be described in detail immediately hereinafter.

Turning to FIGS. 7*b* and 7*c* in conjunction with FIG. 7*a*, a modified power pin 210' has been provided. FIG. 7*b* is an elevational, exploded view in partial cross section while FIG. 7*c* is a fragmentary view in elevation and partial cross-section, taken within a circle 7*c*-7*c* show in FIG. 7*b*. In this embodiment, modified power pin 210' is configured for supporting a coaxial connector assembly 300 including a coaxial plug 302 and a coaxial receptacle 304. While FIG. 7*c* shows plug 302 and receptacle 304 disconnected for purposes of illustrative clarity, it is to be understood that the plug and receptacle are mated for operation of the assembly. Current transformer leads 164*a* and 164*b* extend through inside passage 280 and are electrically connected to a pair of terminals 310 of receptacle 304. Electrical conductors 312*a* and 312*b* from cable 100, which can be a coaxial cable in this embodiment, are electrically connected to a pair of terminals 320 of plug 302. It is noted that some components such as, for example, upper insulator 240 can be subject to minor modification in order to accommodate coaxial connector assembly 300, however, such minor modifications are considered to be within the capabilities of one having ordinary skill in the art with this overall disclosure in hand. It should be appreciated that the electrical connections to current transformer 160 from cable 100 are maintained in electrical isolation from the adapter body and therefore from the drill string itself. This isolation can reduce common mode noise that may be coupled onto the drill string, for example, as the result of the presence of 50 Hz or 60 Hz ground current and noise in an inground environment.

FIG. 7*d* is a further enlarged diagrammatic fragmentary cross-sectional view of another embodiment of the coupling adapter comparable to the views of FIGS. 6 and 7*c*, but which is limited to illustrating a region 350 around the current transformer and cylindrical ring, shown here for purposes of illustrating shock mounting features that can be used with the embodiments of FIGS. 6 and 7*c*, as well as any other suitable embodiment that employs a current transformer supported by an adapter main body 120". In this embodiment, current transformer 160 can be electrically connected using electrical conductors indicated by the reference number 164', for example, in a manner that is consistent with FIGS. 6 and 7*c*, as described above, wherein one or both electrical conductors can be routed through inside passage 280. In the present embodiment, annular shock support members are used to support current transformer 160 in a way that provides for mitigation of mechanical shock and vibration forces. In particular, a first pair of annular members 354*a* and 354*b* is positioned in one lateral direction from current transformer 162 while a second pair of annular members 356*a* and 356*b* is positioned laterally on an opposite side of the current transformer. Further, an outer annular member 358 is positioned between an outer side or periphery of the current transformer and an inner side of cylindrical ring 144. It is noted that the winding on the current transformer has not been show for purposes of illustrative clarity. One or more electrical conductors 164' can be routed through the various annular members in any suitable manner such as, for example, by forming a notch or groove through the annular members. It should be appreciated that an additional annular or ring member can be provided at the inside diameter of the current transformer which can correspond in width to the current transformer or be configured as wider, even up to the full width of groove 162. The additional annular member has not been shown for purposes of illustrative clarity. In this regard, it should be appreciated that outer annular member 358 can have a width that is up to the width of groove 162. Further, either one or both of the pairs of annular members to the sides of the current transformer can be replaced by a single annular member of suitable width. In view of these discussions, it should be apparent that a wide variety of modifications to the illustrated arrangement for shock mounting the current transformer will be apparent to one of ordinary skill in the art with this overall disclosure in hand, while remaining within the scope of the appended claims. For example, a U-shaped annular member can be initially positioned in groove 162 to receive the current transformer with an optional cylindrically configured member arranged outward of the U-shaped member. The various annular shock mitigation members can be formed from any suitable material such as, for example, a resilient foam material. In one embodiment, a high temperature foam material can be used. Such foam materials, either currently available or yet to be developed, can be resistant to temperatures up to and including 120 degrees Centigrade and can include, by way of example, a silicone foam. The various annular members can be held in position, for example, by a suitable adhesive that will generally have sufficient flexibility in terms of the downhole environment. In another embodiment, an adhesive foam tape can be used to form the various annular shock mitigation members. In still another embodiment, current transformer 160 can be potted in groove 162 using a soft or resilient potting compound, such as, for example, polyurethane or electronic grade RTV for purposes of providing mechanical shock and vibration isolation of the current transformer from inground operations involving the drill string. As in previous embodiments, cylindrical ring 144 can be recessed by a distance d so as to avoid potential damage and/or wear as a result of being subjected to clamping at the drill rig or inground wear within the ground, for example, due to co-rotation with the drill string.

Referring to FIG. 7*e*, one-half of current transformer 160 is shown for purposes of illustrating another embodiment for isolating the current transformer from mechanical shock and vibration. It is noted that edges of annular recess 162 are diagrammatically shown by dashed lines proximate to the current transformer. In particular, current transformer 160 can be shock mounted using any suitable number of donut or spacer members 360. Moreover, the spacer members can have any suitable arc width in the annular recess. In one embodiment, three spacer members can be used with a suitable or at least approximately even distribution around the periphery of the current transformer. Each spacer member can define a center aperture for receiving the current transformer. Since the current transformer is provided in two halves, spacer members 360 can readily be installed on each current transformer half prior to installation of the current transformer into groove 162. When the current transformer is provided in two halves, each half can support two or more shock mitigation spacer ring members. The spacer ring members can be formed from any suitable material such as, for example, the materials described above with respect to the annular shock mitigation annular members of FIG. 7*d* including, but not limited to silicone foam. Moreover, current transformer 160 can be potted in position, as described above, using spacer members 360 as centering devices during application of the resilient potting compound. A potting compound 362 is diagrammatically shown in FIG. 7*e* within the confines of the edges of groove 162, as represented by dashed lines around the current transformer. As described above, the potting compound can be used in one embodiment without the spacer rings.

Accordingly, a shock isolated and mounted current transformer and associated method have been brought to light herein. The housing which supports the current transformer includes a housing body that is removably insertable at one of the joints of the drill string as the drill string is extended to thereafter form part of the drill string. The housing is configured at least for receiving the current transformer with the current transformer inductively coupled to the drill string. A support arrangement resiliently supports the current transformer on the housing body such that the current transformer is isolated at least to some extent from a mechanical shock and vibration environment to which the housing is subjected responsive to the inground operation.

In view of the foregoing, it should be appreciated that, in some cases, a drill pipe section can be configured to support a current transformer in a manner that is consistent with the descriptions above, for example, when the drill pipe section includes a sidewall thickness that is sufficiently thick for purposes of defining a support groove for the current transformer without unduly weakening the drill pipe section. Additionally, a drill pipe section having a sidewall of sufficient thickness can support the electrical connections, passages and assemblies described above with limited or no modification as will be recognized by one having ordinary skill in the art with this overall disclosure in hand.

FIG. 8 is a diagrammatic view, in perspective, which illustrates inground tool 20 in the form of a boring tool having drill head 50. In this embodiment, inground housing 54 includes slots 400 for purposes of emitting signal 66 from transceiver 64 (FIG. 1). Coupling adapter 60 is removably attached to inground housing 54 which is itself ready for removable attachment to a distal end of the drill string.

FIG. 9 is a diagrammatic view, in perspective, which illustrates inground tool 20 in the form of a reaming tool including a reamer 420 that is removably attached to one end of inground housing 54. Housing 54 and coupling adapter 60 are otherwise provided in this embodiment in the same manner as in FIG. 8. The reaming tool is pulled in a direction 422, which is indicated by an arrow, for purposes of enlarging a borehole as the reaming tool is pulled toward the drill rig by the drill string. An opposing end of the reaming tool is attached to one end of a tension monitoring arrangement 430. An opposing end of the tension monitoring arrangement can be attached to a utility (not shown) that is to be pulled through the enlarged borehole for installation of the utility in the borehole. Tension monitoring arrangement 430 measures the pull forces that are applied to the utility during the reaming operation. One suitable and highly advantageous tension monitoring arrangement is described in U.S. Pat. No. 5,961,252 which is commonly owned with the present application and incorporated herein by reference in its entirety. Tension monitoring arrangement 430 can transmit an electromagnetic signal 434 upon which tension monitoring data can be modulated. Signal 434 can be received by transceiver 64 (FIG. 1) such that corresponding data can be placed upon the drill string using current transformer 160 (see FIGS. 3-6) for transmission to the drill rig. It should be appreciated that a wireless signal can be received from any form of inground tool by transceiver 64 and that the present embodiment, which describes a tension monitoring arrangement, is not intended as limiting. For example, a mapping arrangement can be used in another embodiment in place of the tension monitoring arrangement. Such a mapping arrangement can operate, for example, using an inertial navigation system (INS).

FIG. 10 is a block diagram which illustrates one embodiment of an electronics section, generally indicated by the reference number 500, that can be supported in inground housing 54. Section 500 can include an inground digital signal processor 510 which can facilitate all of the functionality of transceiver 64 and processor 70 of FIG. 1. Sensor section 68 is electrically connected to digital signal processor 510 via an analog to digital converter (ADC) 512. Any suitable combination of sensors can be provided for a given application and can be selected, for example, from an accelerometer 520, a magnetometer 522, a temperature sensor 524 and a pressure sensor 526 which can sense the pressure of drilling fluid. Current transformer 160 can be connected for use in one or both of a transmit mode, in which data is modulated onto the drill string, and a receive mode in which modulated data is recovered from the drill string. For the transmit mode, an antenna driver section 530 is used which is electrically connected between inground digital signal processor 510 and current transformer 160 to drive the antenna. Generally, the data that can be coupled into the drill string can be modulated using a frequency that is different from any frequency that is used to drive a dipole antenna 540 that can emit aforedescribed signal 66 (FIG. 1) in order to avoid interference. When antenna driver 530 is off, an On/Off Switcher (SW) 550 can selectively connect current transformer 160 to a band pass filter (BPF) 552 having a center frequency that corresponds to the center frequency of the data signal that is received from the drill string. BPF 552 is, in turn, connected to an analog to digital converter (ADC) 554 which is itself connected to digital signal processing section 510. Recovery of the modulated data in the digital signal processing section can be readily configured by one having ordinary skill in the art in view of the particular form of modulation that is employed.

Still referring to FIG. 10, dipole antenna 540 can be connected for use in one or both of a transmit mode, in which signal 66 is transmitted into the surrounding earth, and a receive mode in which an electromagnetic signal such as, for example, signal 434 of FIG. 9 is received. For the transmit mode, an antenna driver section 560 is used which is electrically connected between inground digital signal processor 510 and dipole antenna 540 to drive the antenna. Again, the frequency of signal 66 will generally be sufficiently different from the frequency of the drill string signal to avoid interference therebetween. When antenna driver 560 is off, an On/Off Switcher (SW) 570 can selectively connect dipole antenna 540 to a band pass filter (BPF) 572 having a center frequency that corresponds to the center frequency of the data signal that is received from the dipole antenna. BPF 572 is, in turn, connected to an analog to digital converter (ADC) 574 which is itself connected to digital signal processing section 510. Transceiver electronics for the digital signal processing section can be readily configured in many suitable embodiments by one having ordinary skill in the art in view of the particular form or forms of modulation employed and in view of this overall disclosure.

Referring to FIGS. 1 and 11, the latter is a block diagram of components that can make up one embodiment of an aboveground transceiver arrangement, generally indicated by the reference number 600 that is coupled to drill string 16. An aboveground current transformer 602 is positioned, for example, on drill rig 14 for coupling and/or recovering signals to and/or from drill string 16. Current transformer 602 can be electrically connected for use in one or both of a transmit mode, in which data is modulated onto the drill string, and a receive mode in which modulated data is recovered from the drill string. A transceiver electronics package 606 is connected to the current transformer and can be battery powered. For the transmit mode, an antenna driver section 610 is used which is electrically connected between an aboveground digital signal processor 620 and current transformer 602 to drive the current transformer. Again, the data that can be coupled into the drill string can be modulated using a frequency that is different from the frequency that is used to drive dipole antenna 540 in inground housing 54 (FIG. 1) in order to avoid interference as well as being different from the frequency at which current transformer 160 (FIG. 10) couples a signal onto the inground end of the drill string. When antenna driver 610 is off, an On/Off Switcher (SW) 620 can selectively connect current transformer 602 to a band pass filter (BPF) 622 having a center frequency that corresponds to the center frequency of the data signal that is received from the drill string. BPF 622 is, in turn, connected to an analog to digital converter (ADC) 630 which is itself connected to digital signal processing section 620. It should be appreciated that digital signal processing section 620 and related components can form part of processing arrangement 46 (shown using a dashed line) of the drill rig or be connected thereto on a suitable interface 632. Transceiver 606 can send commands to the inground tool for a variety of purposes such as, for example, to control transmission power, select a modulation frequency, change data format (e.g., lower the baud rate to increase decoding range) and the like. Transceiver electronics for the digital signal processing section can be readily configured in many suitable embodiments by one having ordinary skill in the art in view of the particular form or forms of modulation employed and in view of this overall disclosure.

Referring to FIG. 1, in another embodiment, another coupling adapter 60 and another instance of inground housing 54 or 54', with current transformer 160 connected to transceiver 606 (FIG. 11) be inserted as a unit into one of the joints of the drill string to serve in the manner of a repeater, by way of example, 1000 feet from the inground tool. The repeater unit can be inserted in the joint formed between drill pipe sections 1 and 2 in FIG. 1. The inground housing, for use in a repeater application, can include a box fitting at one end and a pin fitting at an opposing end. Of course, one of ordinary skill in the art will recognize that box to pin fitting adapters are well known and readily available. In another embodiment, coupling adapter 60 can be inserted into a joint with the repeater electronics housed in a pressure barrel that can be supported by centralizers within the through passage of an adjacent drill pipe section. In yet another embodiment, the repeater electronics can be placed in an end loaded or side loaded housing and inserted into the drill string and with electrical communication to the coupling adapter. Such end or side loaded housings can include passages that allow for the flow of drilling fluid therethrough. In any of these embodiments, of course, the repeater electronics can be electrically connected to the coupling adapter current transformer in a manner that is consistent with the descriptions above. In order to avoid signal interference and by way of non-limiting example, the current transformer can pick up the signal originating from the inground tool or another repeater at one carrier frequency and the repeater electronics can retransmit the signal up the drill string from the current transformer at a different carrier frequency in order to render the received signal distinguishable from the repeater signal that is coupled back to the drill string. As another example, suitable modulation can be used to make the repeater signal distinguishable from the received signal. Thus, the repeater electronics package is received in the housing cavity of the inground housing and is in electrical communication with the signal coupling arrangement of the coupling adapter for producing a repeater signal based on the received data signal, but which is distinguishable from the received data signal. The repeater signal is provided to the signal coupling arrangement such that the signal coupling arrangement electromagnetically couples the repeater signal back to the drill string for transfer of the repeater signal as another electrical signal along the drill string such that the repeater signal is electrically conducted by at least some of the electrically conductive drill pipe sections making up a different portion of the drill string.

The foregoing description of the invention has been presented for purposes of illustration and description. It is not intended to be exhaustive or to limit the invention to the precise form or forms disclosed, and other embodiments, modifications and variations may be possible in light of the above teachings wherein those of skill in the art will recognize certain modifications, permutations, additions and sub-combinations thereof.

What is claimed is:

1. An apparatus for use in a system in which an inground tool is moved through the ground in a region for performing an inground operation, said system including a drill rig and a drill string which extends between said inground tool and said drill rig and is configured for extension and retraction from said drill rig, said drill string being made up of a plurality of electrically conductive drill pipe sections for removable attachment to one another and to the inground tool to form a plurality of joints, and said inground tool includes an electronics package for at least one of generating and receiving a data signal relating to the operation of the inground tool, said apparatus comprising:

a coupling adapter having an adapter body that is removably insertable at one of the joints and said adapter body including a sidewall having a sidewall thickness such that said sidewall defines (i) an annular recess for receiving a current transformer for electromagnetic communication with the drill string such that the drill string serves as an electrical conductor for carrying the data signal, (ii) an internal passage which provides for said flow of drilling fluid through the adapter at any installed location of the adapter in said drill string and (iii) a sidewall aperture extending through said sidewall thickness and spaced apart from the annular recess on the adapter body; and a high pressure electrical connector that is received substantially within said sidewall aperture to form an electrical connection that couples the data signal between the inground tool and the current transformer through said sidewall aperture in electrical isolation from the coupling adapter while sealing the drilling fluid within the internal passage of the coupling adapter.

2. The apparatus of claim 1 wherein said current transformer includes a current transformer lead and said electronics package includes a cable and wherein the high pressure connector removably electrically couples the current transformer lead to the cable.

3. The apparatus of claim 1 wherein said adapter body includes a main body that is configured for removable engagement with an extension body such that the main body defines said annular recess which receives the current transformer therein and which main body further receives a nonmagnetic ring in an installed position to cover said annular recess and said current transformer such that the main body and the extension body cooperate to capture the nonmagnetic ring in the installed position with the extension body installed on the main body.

4. The apparatus of claim 3 wherein the main body defines a peripheral shoulder and the extension body defines a flange such that the flange confronts the peripheral shoulder when the extension body is installed on the main body to capture the nonmagnetic ring between the peripheral shoulder and the flange.

5. The apparatus of claim 3 wherein said nonmagnetic ring is cylindrical in shape.

6. The apparatus of claim 5 wherein said nonmagnetic ring is a ceramic ring.

7. The apparatus of claim 6 wherein said ceramic ring is transformation toughened zirconium oxide ceramic.

8. An apparatus for use in a system in which an inground tool is moved through the ground in a region for performing an inground operation, said system including a drill rig and a drill string which extends between said inground tool and said drill rig and is configured for extension and retraction from said drill rig, said drill string being made up of a plurality of electrically conductive drill pipe sections for removable attachment to one another and to the inground tool to form a plurality of joints, said apparatus comprising:

a coupling adapter having an adapter body that is removably insertable at one of the joints, said adapter body including a main body that is configured for removable engagement with an extension body such that the main body defines an annular recess for receiving a current transformer therein for electromagnetic communication with the drill string such that the drill string serves as an electrical conductor for carrying the data signal and which main body is configured to receive a nonmagnetic ring in an installed position to cover said annular recess and said current transformer, and to receive an extension body that cooperates with the main body to capture the nonmagnetic ring in an installed position with the extension body installed on the main body.

* * * * *